United States Patent [19]

Kamiuchi et al.

[11] 3,991,232

[45] Nov. 9, 1976

[54] METHOD OF MANUFACTURING AN ELECTRICALLY INSULATED COIL

[75] Inventors: Junichi Kamiuchi; Taichi Takechi; Hisayasu Mitsui; Ryozi Kumazawa; Kimikazu Umemoto; Toshimitsu Yamada, all of Yokohama, Japan

[73] Assignee: Tokyo Shibaura Electric Co., Ltd., Kawasaki, Japan

[22] Filed: Mar. 11, 1975

[21] Appl. No.: 557,373

[52] U.S. Cl. ..... 427/116; 427/104; 427/295; 427/302; 264/134; 264/272

[51] Int. Cl.[2] ..... B05D 5/12; B05D 3/00

[58] Field of Search ..... 427/116, 104, 295, 302; 264/272, 134

[56] References Cited

UNITED STATES PATENTS

| | | | |
|---|---|---|---|
| 3,042,743 | 7/1962 | Jones | 427/116 |
| 3,071,496 | 1/1963 | Fromm et al. | 427/295 |
| 3,127,470 | 3/1964 | Andersson | 427/116 |
| 3,412,354 | 11/1968 | Sattler | 427/116 |
| 3,503,797 | 3/1970 | Hagiwara | 427/116 |
| 3,504,431 | 4/1970 | Guilbault | 427/116 |
| 3,813,294 | 5/1974 | Dyer | 427/116 |

*Primary Examiner*—Michael F. Esposito
*Attorney, Agent, or Firm*—Cushman, Darby & Cushman

[57] ABSTRACT

A method of manufacturing an electrically insulated coil having excellent insulation characteristics and high reliability using a vacuum-pressure impregnation process comprises the step of selectively effectively combining epoxy resins, curing agents and curing accelerators employed as a mica bonding agent and an impregnant.

3 Claims, No Drawings

METHOD OF MANUFACTURING AN ELECTRICALLY INSULATED COIL

This invention relates to a method of manufacturing an electrically insulated coil using a vacuum-pressure impregnation process.

Recently, as a result of applying a high voltage and large capacitance to an electric appliance, high electrical intensity and mechanical strength are demanded of an electrically insulated coil for use with such an electric appliance.

Conventionally, as the method of manufacturing an electrically insulated coil capable of satisfying such demand there has been adopted a vacuum-pressure impregnation process which comprises winding a mica sheet or tape around a coil, subjecting said coil as a whole to vacuum-desiccation to remove the solvent, water content or the like, subsequently vacuum-impregnating a non-solvent resin such as polyester, epoxy resin or the like into space portions within the insulation body of the coil, thereafter applying a pressure to the resultant coil, and solidifying the non-solvent resin. Where the electrically insulated coil is manufactured utilizing the foregoing process, use is made of (1) compounds (thermoplastic bituminous material), (2) unsaturated polyester, (3) epoxy resins or the like, as the impregnant while use is made of the corresponding materials to those constituting said impregnant, as the mica bonding agent. The above enumerated material (1) has a defect in heat-resistance, and the material (2) has a defect in heat-resistance and water-resistance, respectively. Accordingly, the materials (1) and (2) have recently been little in use, and the last-mentioned epoxy resins (3) having high water-resistance and excellent electrical characteristics have principally been adopted. However, the combinations of curing agents and curing accelerators and the types of epoxy resins result in a wide variety of range. Where, therefore, the epoxy resins are employed as the impregnant, combinations made by taking only the properties of such materials into consideration do not serve as those fully satisfying the necessary requirements for the manufacturing steps.

For this reason, an insulated coil of highly reliable quality can not easily be obtained with the result that the characteristic of the coil so produced frequently presents a high degree of variation to become a cause of coil accidents.

This invention has been achieved in view of the aforesaid circumstances, and is intended to provide a method of manufacturing a highly reliable, electrically insulated coil of excellent quality having the characteristics enabling the coil manufacturing steps (pressure-molding and solidifying steps) to be stably carried out.

That is, the characterizing feature of the invention resides in that in the manufacture of an electrical insulation coil by the vacuum-pressure impregnation process employing epoxy resins the above object has been attained by selectively effectively combining epoxy resins, curing agents and curing accelerators used as the impregnant and the mica bonding agent.

The method of manufacturing an electrically insulated coil according to the invention will now be described. A mica tape coated with a varnish (mica bonding agent) containing 0.3 to 1.5 weight parts or preferably 0.3 to 1.0 weight parts of boron trifluoride series latent curing agent based on 100 weight parts of epoxy resin is wound around a coil, and the resultant coil is subjected to preliminary desiccation by vacuum-heating. The amount of varnish used as said mica bonding agent is preferred to account for 10 to 20% of the sum amount of mica and reinforcing material. A mica tape coated with such mica bonding agent remains stable, highly flexible due to little solidification, highly operable and durable for long use, and further is not affected by heating (up to about 90° C) performed in preliminarily desiccating said resultant coil.

Next, an impregnation resin consisting of acid anhydride series curing agent and cycloaliphatic epoxy resin is impregnated under vacuum-pressure into the preliminarily desiccated coil. Subsequently, the coil impregnated is fastened with a metal pad applied thereto and is subjected to solidification, thereby obtaining a final coil product. At this time, though the impregnation resin itself is low in viscosity and accordingly low in solidification speed, it reaches the mica tape layer and is mixed with the mica bonding agent to become integral therewith, so that the boron trifluoride series latent curing agent contained in the mica bonding agent concurrently acts on the impregnation resin as a curing accelerator. For this reason, the solidification speed is effectively adjusted during the solidification step to form an ideal insulation body with the aid of the fastening force.

As the epoxy resin of the mica bonding agent a bisphenol epichlorohydrin series epoxy resin (for example, Epikotes 828 and 1001 manufactured under such trade names by Shell Chemical Company or DER 331 and DER 661 manufactured under such trade names by Dow Chemical Company) is preferably used in a single or mixed form. Further, as the boron trifluoride series latent curing agent complex salts such as $BF_3$-monoethylamine, $BF_3$-piperidine, $BF_3$-benzylamine or the like are suitable. Further, as the acid anhydride series curing agent acid anhydrides such as hexahydronaphthalic anhydride, methylhexahydrophthalic anhydride, methyltetrahydrophthalic anhydride, methylnadic anhydride or the like preferably are respectively used in a single or mixed form. Further, as the cycloaliphatic epoxy resin, Chissonox 221 (manufactured under such trade name by Chisso Company) and a glycidyl epoxy-type epoxy resin (for example, XB-2610 manufactured under such trade name by Ciba Geigy Company) can be employed. In addition, for the purpose of decreasing the impregnation viscosity of the impregnant, an epoxy series reactive diluent (for example, butylglycidylether or arylglycidylether) can be added to the impregnant as required.

As above described, because of a good adaptability between the mica bonding agent and impregnation resin as selectively effectively mutually combined the electrically insulated coil manufactured by the above-mentioned method has an excellent electrical, mechanical and thermal characteristics and is maintained highly reliable in quality.

This invention will be more fully understood by reference to the concrete example which follows.

EXAMPLE

Five types of varnishes (a 50% solution of methylethylketon) were first prepared each of which has such a resin composition as is shown in the respective columns of examples 1 to 3 and controls 1 and 2 of Table 1. The varnish so prepared was coated on a mica sheet consisting of a bonded mica paper or flake mica and glass reinforcing material as a lining material to obtain a mica tape. The mica tape was wound around a coil whose elemental wire is previously insulated, and the resultant coil was introduced into an impregnation tank and was subjected to preliminary vacuum desiccation under a temperature of 70° to 80° C and under a pressure of 0.3 mm Hg. Subsequently, said coil was cooled to normal temperature and was vacuum-impregnated with an impregnation resin consisting of acid anhydride and cyclo-aliphatic epoxy resin, and thereafter was subjected to a pressure of 7 kg/cm² for 15 hours.

Thereafter, said coil was taken out of the impregnation tank, and a metal pad was applied to the taken-out coil. The resultant coil was wound with a thermal shrinkable tape such as shrinkable polyester tape and was gradually heated for solidification, and thereafter was finally heated for 20 hours at a temperature of 150° C to obtain a final product, i.e., an electrically insulated coil.

The coil thus obtained has such electrical characteristics as presented in Table 2. The respective coils obtained from the examples 1, 2 and 3 had a prescribed dimension and a good insulation layer having a uniform thickness. On the other hand, the surface of the insulation layer of the coil according to the control 1 was coloured whitish, which indicates that the impregnation resin flows out from the surface of the insulation layer and accordingly is not held therein. The coil according to the control 2 presented a good appearance but the insulation layer thereof failed to be sufficiently compressed to have a somewhat larger thickness. When this coil was cut off, an impregnation resin layer proved to be formed thick between the insulation layers and to have innumerable small cracks.

Since, in the insulated coil of the invention, the boron trifluoride series latent curing agent affects the suitability of the coil itself, the addition amount thereof is of great importance. Namely, as apparent from the results of the examples 1 to 3 and controls 1 and 2, it is when 0.3 to 1.5 weight parts or preferably 0.3 to 1.0 weight part of said latent curing agent based on 100 weight parts of epoxy resin was added thereto that a good result is obtained. Where a solid cyclo-aliphatic epoxy resin (for example, LT 580 manufactured under such trade name by Ciba Geigy Company) was used as the mica bonding agent, the reaction of the mica bonding agent with the impregnation resin, when the former was mixed with the latter, was promoted due to the high reactivity of boron trifluoride series latent curing agent and cyclo-aliphatic epoxy resin, so that a result similar to the control 2 was obtained to present a low suitability.

Table 1

| | | Example 1 | Example 2 | Example 3 | Control 1 | Control 2 |
|---|---|---|---|---|---|---|
| Components of mica bonding agent | A | 70 weight part of DER 331 | 60 weight part of Epikote 828 | 60 weight part of Epikote 828 | 70 weight part of Epikote 828 | 60 weight part of Epikote 828 |
| | | 30 weight part of DER 661 | 40 weight part of DEN 438 | 40 weight part of DEN 438 | 30 weight part of Epikote 1001 | 40 weight part of DEN 438 |
| | B | 0.3 weight part of $BF_3$-mono-ethylamine | 1.0 weight part of $BE_3$-piperidine | 1.5 weight part of $BF_3$-piperidine | — | 3 weight part of $BF_3$-piperidine |

A: Epoxy resin
B: Boron fluoride series latent curing agent

Table 2

| Mica bonding agent used | | Δ tan δ Initial value ~ $E/\sqrt{3}$ | Δ tan δ Initial value ~ E | Δ tan δ Initial value ~ 1.5E | BDV KV/mm | Voltage endurance characteristics (hour) |
|---|---|---|---|---|---|---|
| Example | 1 | 0.02 | 0.05 | 0.11 | 26.0 | 800< |
| | 2 | 0.01 | 0.02 | 0.09 | 27.0 | 1000< |
| | 3 | 0.02 | 0.03 | 0.28 | 25.0 | 700< |
| Control | 1 | 0.33 | 1.33 | 1.70 | 19.0 | — |
| | 2 | 0.18 | 0.55 | 0.78 | 17.5 | 200 ~ 300 |

In the above Table 2, E represents the rated voltage, the initial value is the value of the tan δ at the nonionization time when it does not rise, in the case where the low voltage as applied is gradually increased in measuring the tan δ value, BDV is the insulation breakdown voltage, and the voltage endurance characteristic is the length of time required for the voltage having a voltage inclination of 9.5 KV/mm to be applied until the insulated layer is broken-down.

As above described, a highly reliable electrically insulated coil of excellent quality having the characteristics enabling the coil manufacturing steps (pressure-molding and solidifying steps) to be stably carried out can be obtained, in the present method of manufacturing an electrically insulated coil by vacuum-pressure impregnation process employing epoxy resins, by selectively effectively combining epoxy resins, curing agents and curing accelerators used as the impregnant and the mica bonding agent.

Though, as heretofore mentioned, the coil, to which the mica bonding agent and the impregnant are only applied, presents, as it is, a sufficient performance, the mutual adaptability between the mica bonding agent and impregnant can further be increased by previously applying, before the mica bonding agent is coated on the mica tape, an uncured epoxy powder containing therein a curing agent which is solid at normal temperature as an adhesive between the mica sheet and the reinforcing material. This is because the respective solidification speeds of the impregnation resin and the mica bonding agent within the insulation layer are kept constant by said previous application of said powder. Namely, within the mica layer there will be attained the distribution of a small amount of impregnation resin and a large amount of mica bonding agent while between the mica layers there will be created a layer having the distribution of a small amount of adhesive and a large amount of impregnation resin. Accordingly, in any portions of the mica layer section the solidification is properly advanced due to the presence of curing agent, i.e., the boron trifluoride series latent curing agent within the mica layer and the latent curing agent contained in the powder between the mica layers, so that a uniform insulation layer having a good suitability is formed during the solidification step.

In case of the foregoing uncured epoxy powder containing curing agent therein, for example, a bisphenol series solid epoxide (Epikotes 1001, 1004 and 1007 manufactured under such trade names by Shell Chemical Company) is desirable as said epoxide resin, and, for example, the latent curing agent in the said powder such as anhydride dicyandiamide, diaminodiphenylmethane or imidazole, is suitable as said curing agent. The amount of said powder between mica sheet and reinforcing materials is preferred to account for 3 to 12 weight % of the adhesive powder based on the sum amount of mica sheet and reinforcing material. The reason is that in case of less than 3 weight % the solidification promoting action between the impregnation resin and said powder is rendered ineffective whereas in case of more than 12 weight % the action of said powder is rendered too effective to render the resultant mica tape inflexible with the result that its resin impregnability and operability are decreased to render it unsuitable.

Further, by applying, in addition to said previous application treatment for said powder, a mica layer flow-preventing agent to the mica tape there can be obtained a more highly reliable insulated coil. That is, where no mica layer flow-preventing agent is applied to the mica tape, it often happens that when the mica tape of the coil after completion of resin impregnation is pressed by fingers, the mica layer is displaced. This produces the possibility that in case of the manufacture of an elongate, large coil a mica layer flow takes place due to the molding pressure during the solidification step performed after a metal pad is applied to an unfinished coil, which undesirably affects the characteristics of the coil after solidification. Such mica layer flow-preventing agent application is performed by using as small an amount of normal temperature solidifiable epoxy resin composition as 0.1 to 1 weight % based on the sum amount of, for example, mica tape and reinforcing material. A coil wound with a mica tape subjected to previous application as the mica layer flow-preventing agent of 0.5% of normal temperature solidifiable epoxy resin composition consisting of 100 parts of Epikote 828 and 13 parts of triethylenetetramine based on the sum amount of mica tape and reinforcing material presented no mica layer flow and had good characteristics after solidified.

There will now be described a concrete example of the method of producing a mica tape.

The first step (Bonding step utilizing the epoxy powder):

An epoxy resin of EPX 1346 is applied to a glass cloth having a fiber thickness of 30$\mu$ at the rate of 8g per square meter of the glass cloth, and the resultant glass cloth is fused to a non-dehydrated, bonded mica paper having a thickness of 0.1 mm by a heated roll kept at a temperature range of 125°± 5° C at a speed of 2 m/min. This extent of thermal history, however, does not cause the solidification of the EPX 1346, which permits the EPX 1346 to remain effective as the reaction promoting agent for the impregnating resin.

The second step (Mica layer flow-preventing step):

A varnish consisting of 0.1 kg of Epikote 828, 0.1 kg of TTA (triethylenetetramine), 6.75 kg of toluene and 2.25 kg of methanol is coated as the mica layer flow-preventing agent on the mica sheet obtained in the first step, so as to permit the varnish thus used to amount to 50 ± 5 g/m$^2$. The resultant mica sheet, after passed through a drying stove kept at 60° C at a speed of 2 m/min., is allowed to stand overnight, thereby to cause the mica layer flow-preventing agent to be fully solidified.

The third step (Step for coating the bonding agent):

A varnish consisting of 6 kg of Epikote 828, 4 kg of DEN 438, 0.05 kg of $BF_3$ piperidine, 7.6 kg of methylethylketon and 2.4 kg of toluene is coated as the mica bonding agent on the mica sheet obtained in the second step, so as to permit the varnish thus used to amount to 80 ± 5 g/m$^2$. The resultant mica sheet is passed through a drying stove kept at 80° to 90° C at a speed of 1 m/min. and is thereby dried to obtain a desired mica tape.

What we claim is:

1. A method of manufacturing an electrically insulated coil comprising impregnating a cyclo-aliphatic epoxy resin containing acid anhydride into a coil wound with a mica tape which is obtained by coating a mica sheet consisting of a mica and backing material with a resin material containing 100 weight parts of epoxy resin and 0.3 to 1.5 weight parts of boron trifluoride series latent curing agent, pressure-molding the resultant coil and solidifying the same.

2. A method of manufacturing an electrically insulated coil according to claim 1, wherein an uncured powdered epoxy resin containing a curing agent, solid at normal temperature, is previously applied to an interface between the mica and the backing material and heated to fusion-bond the mica and the backing material.

3. A method of manufacturing an electrically insulated coil according to claim 1, wherein the mica sheet is previously treated with a mica layer flow-preventing agent.

* * * * *